US008950899B2

(12) United States Patent
Chien

(10) Patent No.: US 8,950,899 B2
(45) Date of Patent: Feb. 10, 2015

(54) LIGHT DEVICE WITH DISPLAY MEANS HAS TRACK-MEANS AND REMOVABLE LED-UNITS

(76) Inventor: Tseng-Lu Chien, Walnut, CA (US)

( * ) Notice: Subject to any disclaimer, the term of this patent is extended or adjusted under 35 U.S.C. 154(b) by 360 days.

(21) Appl. No.: 13/162,824

(22) Filed: Jun. 17, 2011

(65) Prior Publication Data

US 2012/0320594 A1 Dec. 20, 2012

(51) Int. Cl.
*F21V 21/14* (2006.01)

(52) U.S. Cl.
CPC ..... *F21V 21/14* (2013.01)
USPC ..... 362/249.03; 362/648; 362/249.07

(58) Field of Classification Search
USPC ..... 362/648, 249.02–249.06, 249.07, 285, 362/239, 418, 419, 234, 253, 362, 372, 800
See application file for complete search history.

(56) References Cited

U.S. PATENT DOCUMENTS

| | | | | |
|---|---|---|---|---|
| 6,547,417 | B2 * | 4/2003 | Lee | 362/249.01 |
| 7,722,230 | B2 * | 5/2010 | Chien | 362/382 |
| 7,726,836 | B2 * | 6/2010 | Chen | 362/249.02 |
| 2002/0176253 | A1 * | 11/2002 | Lee | 362/249 |
| 2007/0285949 | A1 * | 12/2007 | Lodhie et al. | 362/648 |
| 2009/0059606 | A1 * | 3/2009 | Chien | 362/394 |
| 2009/0244925 | A1 * | 10/2009 | Snagel et al. | 362/648 |
| 2011/0248631 | A1 * | 10/2011 | Chuang | 315/32 |

* cited by examiner

*Primary Examiner* — Bao Q Truong
(74) *Attorney, Agent, or Firm* — Bacon & Thomas, PLLC

(57) ABSTRACT

An LED light device includes display means, track-means, and removable LED-unit(s). The use of track-means and removable LED-units allows the number of the LED-units and the arrangements of LEDs on the LED-units to be easily varied in order to provide light devices having a desired cost, brightness, color, viewing angle, illumination direction and/or area functions, and effects. Furthermore, the track-means may have a multiple-surface construction and a desired length of track-means and width of the LED-units to enable further customization of the light device by addition or removal of light units from the different surfaces.

26 Claims, 12 Drawing Sheets

1
2A
2B
2C
2D
3
4

FIG. 7
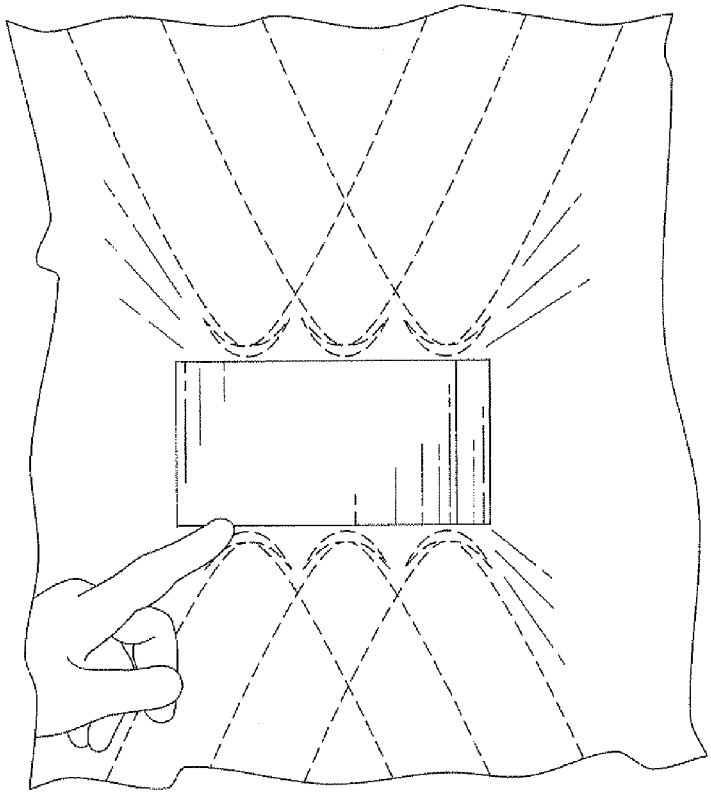
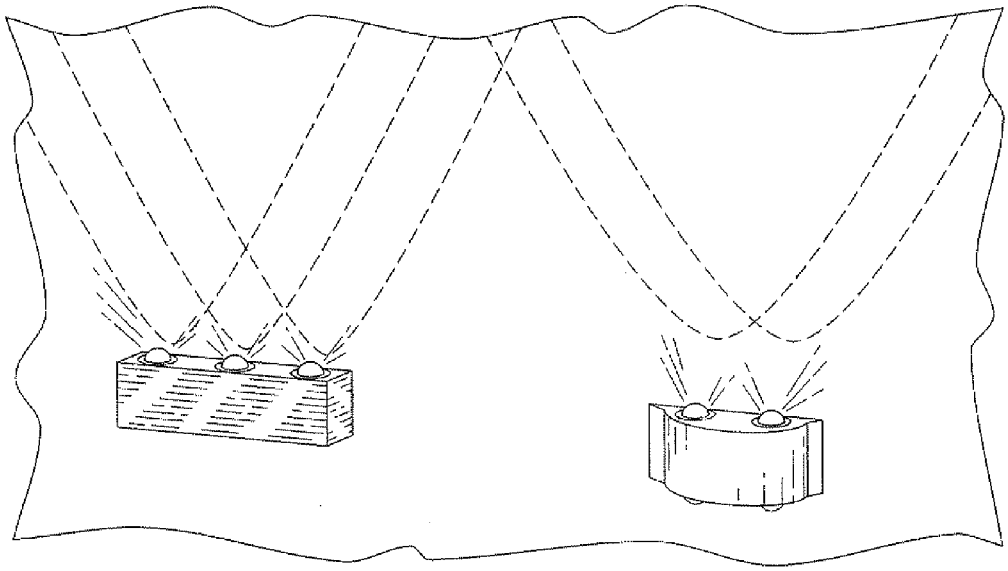
FIG. 8

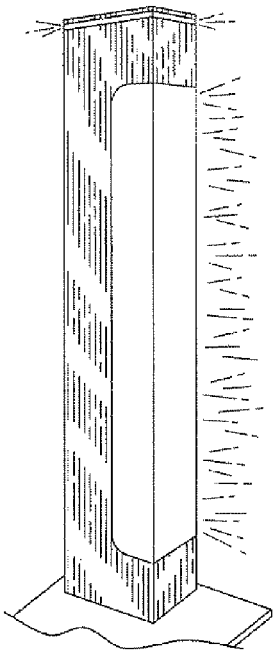
FIG. 11
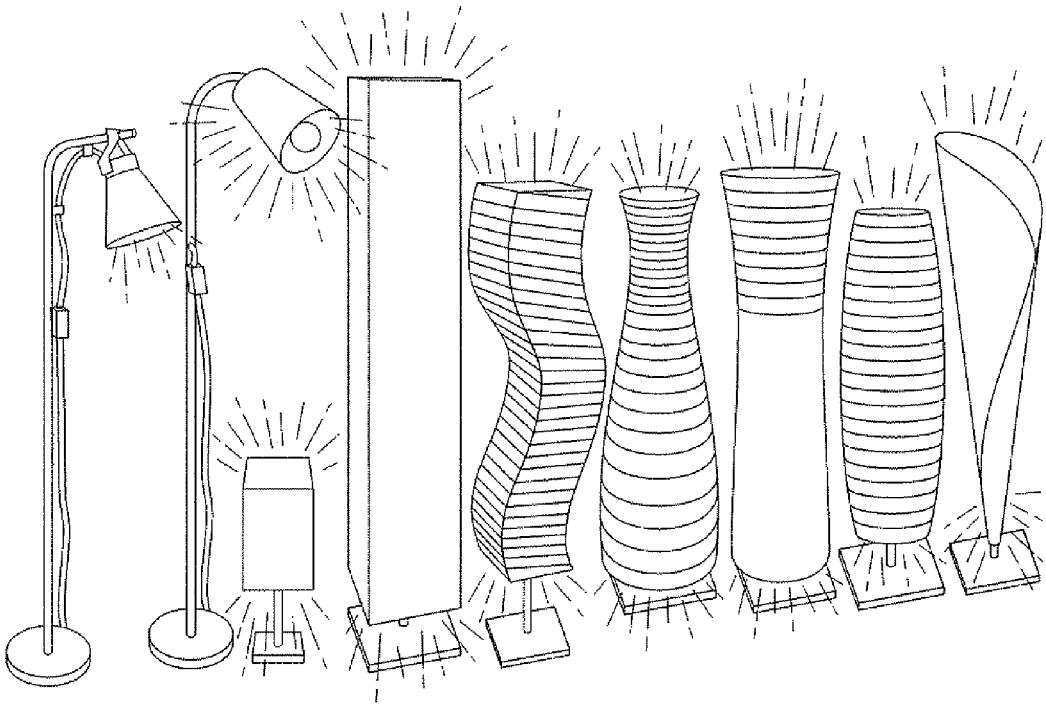

LIGHT DEVICE WITH DISPLAY MEANS HAS TRACK-MEANS AND REMOVABLE LED-UNITS

BACKGROUND OF THE INVENTION

The current invention has subject matter in common with the inventor's U.S. patent application Ser. No. 11/806,285, directed to an LED bulb, and Ser. Nos. 12/003,809, 12/073,889, and 12/894,865, directed to an LED light device having changeable position features, as well as the inventor's issued U.S. Pat. Nos. 7,618,150, 7,726,869, 7,722,230, which are all directed to LED track lights or removable LED-units on track-means for a variety of applications.

U.S. Pat. Nos. 7,618,150 and 7,726,869 disclose an LED track light having removable LED-unit(s) on the track-means (s), the removable LED-unit(s) being connected to the track means by resilient conductive means that allow the removable LED-unit(s) to be moved to any desired position when an outside force applied, while still providing good electrical contact and signal transmission. The LED-unit(s) can be replaced, assembled to, or disassembled from the ends of the track-means. Each of the LED-unit(s) can have any desired number of LED-means to meet preferred specifications, including brightness, size, dimension, color, functions, performance, and effects according to predetermined requirements. The track means can have any geometric shape so long as the shape allows the LED-unit(s) to be removable from the track-means.

The current invention can be used in a variety of applications for an LED track light as listed in the inventor's prior copending and issued patents, the simple LED track light construction providing a plurality of different lighting products for people to use while saving a lot of cost for tooling, printed circuit board (PCB) design, labor, and resources.

According to a preferred embodiment of the present invention, the track means of the LED track light may be made by an extrusion process that forms assemblies of one or more track-means. For example, a single extrusion tooling can be used to form a hexagon construction having 6 track-means to enable LED-unit(s) mounted on the track means to emit light beams in 6 directions. Furthermore, a single extrusion tooling also can be used to form an octagon construction having 8 surfaces that face outward and that enable at least 8 LED-unit (s) within the 8 track-means to emit light in up to 8 directions.

On the other hand, it will be appreciated that the multiple-surface(s) of the track-means can also be made by conventional skill and techniques other than extrusion, using different materials or procedures to get the same function or equivalent features to those of the LED track light concepts discussed in the inventor's prior issued patents and pending patent application. All such variations are intended to still fall within the scope of the current invention.

The LED track-means tooling is very simple and the cost is very cheap, which will allow people to easily construct different applications of an LED lighting fixture, LED bulb, or LED lighting for all purposes. Each track-means can be loaded with a different number of the LED-unit(s) to control the cost of the track-means, with fewer LED-units resulting in a lower cost and more LED-units resulting in an increased cost, so that the variation in the number of LED-units can be used to satisfy cost expectations of all different buyers.

Other features of the track-means include the ability to easily design the LED light device for certain purposes such as a corner light made up of "L" shape track-means in which the LED-unit(s) light beams are only emitted in two directions and no light is emitted into the corner to save a lot of power consumption. In another example, a downwardly facing light for office or production line use can be designed with one track-means that faces down so that no light is emitted to the top or side position to again save power consumption, in contrast to the conventional fluorescent tube or incandescent bulb which has too many light beams and wastes power by illuminating unnecessary areas. The reduction in power consumption is made possible by (1) the narrow viewing angle of the LED-means; (2) the use of a low cost substrate, and preferably a track means, to arrange any number and variety of LED-means; (3) the use of removable LED-unit(s) with resilient conduct means to provide electric signal contact at any time and any location; (4) the use of an ideal geometric shape and dimension of the track-means and LED-unit(s) to perfectly meet different lighting requirements, such as those of an LED bulb, which can be achieved by using super small track-means in hexagon or octagon shape with any number, from one to N, of tiny removable LED-unit(s) depending on production or cost considerations. Alternatively, for a floor light, a larger dimension of track-means and LED-unit(s) is required. The invention enables easy scaling of the track means from 2 or 3 inches for an LED bulb, 2 feet for a desk lamp, 3 feet for a floor lamp or LED florescent tube, 4 feet for an undercabinet light, and 6 feet or more for a downwardly facing work light.

The current invention also provides a method of making an LED-bulb that replaces all kinds of market-available incandescent bulbs with copper bases, by using super compact size track-means and LED-unit(s).

The current invention also teaches how to use an elongate or tubular track-means and LED-unit(s) to make light devices that can replace all sizes of conventional fluorescent tube at a lower cost by using extruded hexagon or octagon shaped track-means with 6, 8, or more surfaces that can be loaded with LED-units to emit light in multiple directions.

Furthermore, the same multiple-surface extruded track-means can be formed in a super long length and simply cut to a desired length such as 1 feet, 2 feet, 3 feet, 4 feet, 5 feet, up to 10 feet, or longer so that it can easily be put into an outside housing, cover, or lens to provide a track means having a same length as an existing fluorescent tube length, including the two end contact terminals so as to easily fit into any existing fluorescent tube housing, base, frame, or holder, the light device incorporating proper circuit means to match the two end contact terminals' output current signal and change the current signal into a signal that drives the said LED-units or LED-means for desired illumination according to predetermined functions, effects, performance, etc. The multiple surface extrusion unit may also form multiple track-means that enable installation of LED-unit(s) at desired locations to enable the LED fluorescent tube (LED-Flo-Tube) to emit light beams to specified area(s) such as an area downward of the tube which forms a 60 degree arc relative to the diameter of the LED-Flo-Tube, with no light being emitted to the remaining of 300 degrees of the tube's diameter away from the downward location to limit the illumination area for the said LED-Flo-tube and substantially reduce power consumption relative to the traditional fluorescent tube.

It will also be appreciated that each LED-unit(s) for the LED-Flo-Tube may extend ⅕ of the super long length of the LED-Flo-Tube length. It is much easier to make a ⅕ length LED-unit(s) than to make a unit that extends the whole length of the tube according to current market practice. Consequently, each track-means only needs 4, 3, 2, or 1 pieces of the LED-unit(s) to be installed into the super long length so that the LED-unit(s) will still be removable. Hence, the use of longer track-means with longer LED-unit(s) will save labor, time, costs, materials, and assembly time, and avoid the disadvantages of existing LED tube lights. This embodiment thus provides great improvements to the LED-Flo-Tube by: (1) limiting the arc of the circle that is illuminated to save power consumption; (2) using longer LED-unit(s) to reduce the assembly time involved in installing the LED-unit(s) into the track-means; (3) preferably using extrusion units having multiple surface track-means to provide the best light emitting directions, as desired; (4) selectively installing LED-units in only a portion of the track means, and leaving the remainder of the track-means not installed with LED-units or with a limited number of LED-unit(s) to meet some customer requirements for low-cost without having to change the basic extrusion unit as the main construction frame, saving not only cost, but also time and labor to redesign different LED-Flo-Tubes with selected specifications.

None of the prior art LED-bulbs, such as the ones disclosed in U.S. Pat. No. 5,924,784 (Chliwnyj et al.), U.S. Pat. No. 6,220,722 (Begemann), U.S. Pat. No. 6,499,860 (Begemann), and U.S. Pat. No. 7,254,089 (Vogelsang et al.), uses a track-means and removable LED-unit(s) to arrange a plurality of LEDs in the LED bulb. The current invention use a simple preferred procedure to extrude track-means having more than one surface(s) and thereby enable a desired number of LED-unit(s) to be arranged within the multiple track-mean (s) on the multiple surface(s) of the extruded single piece, the LED-units each including a desired number of LED(s). Whenever a change in brightness, color, cost, or photometric properties is required, the designed can simply change LED-unit(s) to one with the desired LED specifications and number to meet market requirements in a short time without having to design a new PCB and laboriously install LEDs on the new PCB. Hence, the current invention provides big improvements in the LED bulb.

The current invention may be applied to an LED bulb of the type disclosed in the inventor's copending U.S. patent appl. Ser. No. 11/806,285.

The current invention may also utilize principles disclosed in the inventor's U.S. patent appl. Ser. No. 12/622,000, in which an LED light device is provided with certain blocking means, cutouts, openings, windows, and/or optics means, to allow LED light beams travelling within a light-transmitting medium with multiple reflective means and an appropriate LED position to create geometric art, the present invention utilizing track-means and LED-units to provide LEDs with the desired orientation, position, or location in a three-dimensional coordinate system.

The features of the current invention, and in particular the inclusion of a track-means and removable LED-units, results in a big improvement by enabling people to avoid spending money, time, labor, and resources in order to meet new requirements for different light device specifications. The current light device lets the consumer to make its own light device with preferred LEDs at certain locations because the consumer can easily change the position of the removable LED-units. The consumer can also add or reduce the number of LED-unit(s) to provide different light brightness and cost, or add, reduce, or replace the LED-unit(s) to provide one or more desired colors and illuminate selected areas. Still further, the consumer can also add a preferred shade, cover, housing, or decorative means to further customize the light device. Hence, the current invention of a light device with display means having track-means and removable LED-units is a perfect idea.

It will be appreciated that any alternative or improvement having a same function, equivalent features, or revised components may fall within the scope of the current invention, including features and components described in the inventor's copending or issued U.S. patent applications.

BRIEF DESCRIPTION OF THE DRAWINGS

FIGS. 1-1 to 1-21 are end and perspective views showing details of extruded track-means, LED-units, and LED-means (LEDs) according to preferred embodiments of the invention. The track-means, LED-unit(s), and LED-means are incorporated with appropriate display means to provide a valuable appearance. The track-means are extruded to form a number of surface(s) that enable the LED-units to only illuminated desired areas and optimize power consumption. For example, the track-means can be extruded to form a single track-means, 2 track-means in parallel or at a desired angle, 3 track-means in parallel, 4 track-means forming a "CE" square or rectangular arrangement, 6 track-means in a hexagonal arrangement, 8 track-means in an octagonal arrangement, to offer illumination from 10 degrees up to 360 degree in any of three dimensions.

FIG. 3 is a perspective view of an LED bulb with display-means in the form of a bulb glass cover and having 4 track-means, each track means having 6 LED-means so as to provide an LED bulb with 24 LEDs that face outward to cover 360 degrees and having another LED means arrangement at the top. The LED bulb can have different shapes and bases to match any conventional incandescent bulb. The current invention use a miniature size of track-means and removable LED-units to fit within the incandescent bulb's size and base to permit any incandescent bulb to be replaced by an LED bulb. Furthermore, the current invention can apply the same techniques to replace a conventional fluorescent tube with an LED fluorescent tube (LED-Flo-Tube) having LED means on removable LED-unit(s) to fit within at least one track-means of the LED-Flo-tube with appropriate ends and circuit means to directly use the existing fluorescent tube electric current to turn on and off the LED as desired Alternatively, the new LED-Flo-Tube can be arranged to bypass the conventional fluorescent tube starter system so as to provide a simpler circuit.

FIG. 4 shows various alternative covers, shades, housings, optics lenses, blocking means, stencils, cutouts, openings, windows, or holes that enable the inner LED track-means, LED-unit(s), and LED means to provide all kinds of wall light, which can be applied to a driveway, theater, home, outdoor wall, or surface for offering attractive floor illumination in dark areas, using any material as discussed above.

FIG. 5 shows another wall light application again, in which as in the embodiments of FIG. 4, the inner track-means, LED-unit(s), and LED-means are viewed through a diffuser lens with cutouts, openings, windows, stenciling, holes, printing, laminations, die cuts, heat-transferred or silkscreened patterns, metallization, or other decorative surface finishing as explained in notes included in the original drawings figures. Again, the inner side has the track-means and LED-units and LED-means of the said Light device with display means.

FIG. 6 is a perspective view of a wall light with reading light applications. The display means can be made of any kind of material. Again, the track-means, LED-units, and LED-means of the light device are on an inner side of the display means.

FIGS. 7 and 8 are perspective views of wall lights with display means selected from an optics means, lens, reflector, diffuser lens, filter, light-transmitting medium, reflective means, any other related optics parts and accessories, a cover, a housing, shade, decorative means, cutouts, stencils, windows, and/or openings, to form a geometric art image shown on a surface(s), wall(s), or floor(s). Again, the track-means, LED-units, and LED-means of the light device are on an inner side of the display means.

FIG. 9 shows other wall light applications in which light is emitted outward in desired directions from a cover, housing, or shade having cut-outs, openings, windows, stencils, printing, gaps, and/or rings to emit the light from a plurality of areas on the body. Again, the track-means, LED-units, and LED-means of the light device are on an inner side of the display means.

FIG. 10 shows a special-purpose light application having bubbles as decorative means to cover the inner track-means and LED-units.

FIG. 11 shows a floor light in which the whole length or a partial length has LED-units inside. The inner track-means may have more than 3 surface(s) so as to provide 360 degree illumination. The shade, cover, housing can be made of paper, plastic, bamboo, foldable material, see-though means, opaque means, and/or translucent means, to provide desired illumination for indoor or outdoor use.

FIG. 12, like FIGS. 7 and 8, shows a light device that forms geometric art images on surfaces such as a floor or walls. The light device may use high power LED-means at a center location, a light-transmitting medium, and reflective means to allow the light to spread out through an outer stencil, printing, cutouts, openings, windows, silkscreen, or blocking means to form the geometric art on the surfaces, walls, or floor where they can be seen. The geometric art concept is disclosed in the inventor's copending U.S. patent application Ser. No. 12/622,000, but the concept is modified to utilize the track means and LED units of the present invention.

DETAILED DESCRIPTION OF THE PREFERRED EMBODIMENTS

Figure 1:
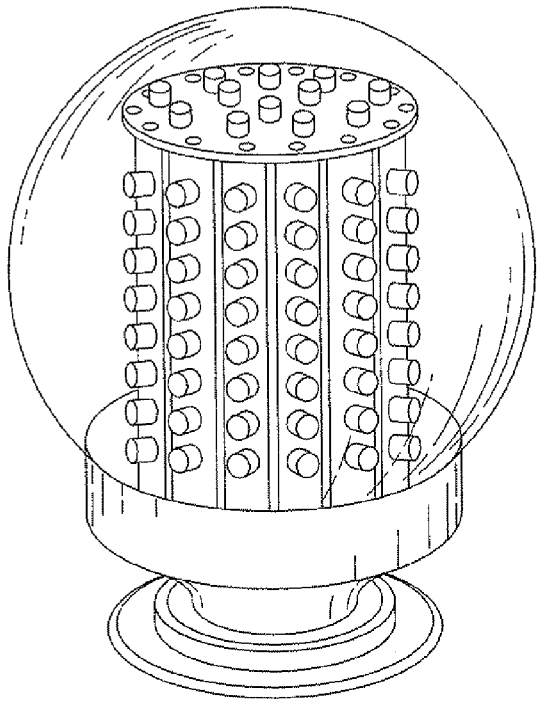
FIG. 1 is a perspective view of an LED bulb with display means (a bulb glass or plastic lens) having more than 10 track-means and 10 removable LED-units installed in the track means. The LED-units can include any number of LED-means (LEDs) for different light brightness, color, functions, and effects. The preferred embodiment may, for example, include 8 LEDs on each LED-units, and each LED-unit is almost same length as the track-means. The top end has one more LED-unit which is not removable to offer light to a top area of said LED bulb.

FIG. 1 shows an LED bulb with display means (a bulb glass or plastic lens), 10 track-means, and 10 removable LED-units installed in the track means. The LED-units can have any number of the LED-means (LEDs) for different light brightnesses, colors, functions, and effects. The preferred embodiment provides 8 LEDs on each LED-units, with the LED-unit length being almost the same length as the track-means. The top end of the light device also includes an LED-unit which is not removable, to illuminate the top area of the LED bulb. As explained in the notes included in the original drawing, the track means may be made by simple aluminum extrusion tooling, as described in more detail below.

Figure 2:
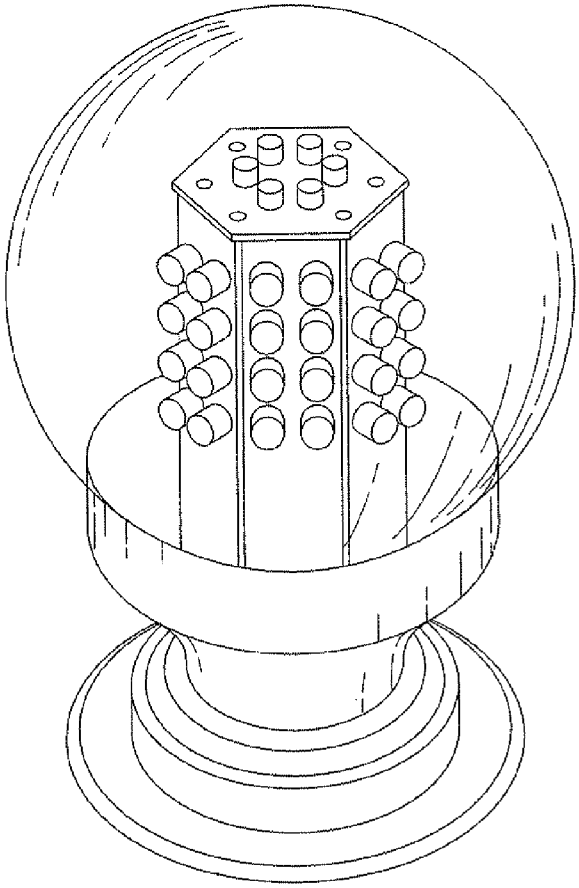
FIG. 2 is a perspective view of an alternative LED bulb which has 8 LED-means (8 LEDs) on each removable LED-units, which are installed within a 6 surface, hexagonal, extruded track-means, the LED-means being arranged in 2 rows with 4 pcs/row, thereby providing 8 LEDs on each LED-unit and light beam emission in 6 directions. The top also has one more LED-unit which is non-removable and held in position by some fixing-means.

FIG. 2 shows an alternative LED bulb which has 8 LED-means (8 LEDs) on each removable LED-unit, the LED-units being installed within 6 extruded track-means that form a hexagon, the LED-means being arranged in 2 rows with 4 LEDs in each row, for a total of 8 LEDs on each LED-unit to emit light beams in 6 directions. The top also has one more LED-unit which is non-removable and is held in position by a fixing-means. As explained in the notes included in the original drawings, the LED-units may be replaced by LED-units having different numbers and arrangements of LEDs, or by different numbers of LED-units.

Figure 1:
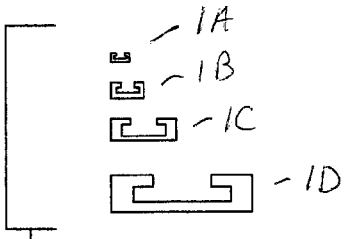
Figures 1, 2, 3, 4, 5:
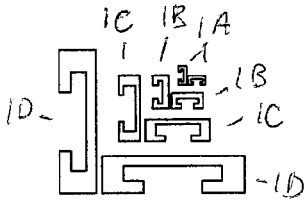

FIGS. 1-1 to 1-21 shows details of track means formed by extrusion, and relationships between track-means, LED-units, and LED-means (LEDs). The track-means, LED-units, and LED-means are incorporated with Display means to provide a more valuable appearance. The current invention preferably uses extrusion to form the track-means with a desired number of surfaces that enable the LED-unit(s) to illuminate selected locations when installed in the track means. For example, the extruded track means may be formed as a single track-means, 2 track-means in parallel or at a certain degree, 3 track-means in parallel, 4 track-means in a "D" square or rectangular arrangement, 6 track-means in a hexagon arrangement, or 8 track-means in an octagon arrangement to offer illumination from 10 degrees up to 360 degrees along any axis of the three dimensional coordinate system. Further details were included as notes in the original drawings and are as follows:

FIG. 1-1 shows single track means 1A-1D for providing a linear LED light device. As illustrated, the track means 1A-1D can have different sizes ranging from miniature (1A), to medium (1B), large (1C), and extra-large (1D). FIG. 1-2 shows pairs of track means 1A-1D arranged side-by-side to double the number of LED-units and therefore the brightness, which is useful for a work light. FIG. 1-3 shows groups of three of the track means 1A-1D arranged side-by-side for even greater brightness. FIG. 1-4 shows groups of four of the track means 1A-1D arranged perpendicularly to form a parallelepiped structure and provide 360° illumination. FIGS. 1-5 to 1-7 show respective L-shaped and stacked arrangements of the track means 1A-1D. The medium track means arrangements can be used for a portable LED light application, while the large size is suitable for bed, desk, camping, garden, outdoor, and indoor 360° illumination. The extra large track means arrangement can be used for floor, patio, table, bed, construction zone, door, garden, playground, swimming pool, camping, and industrial use. FIG. 1-8 shows details of the LED units 2, which include surface mount technology (SMT) LED elements 3 sealed in the units by glue, the units being electrically connected to the track means by resilient conductive means. The parallelepiped shape may be achieved by extrusion molding, and may take the form of a single three-dimensional track means or four one-dimensional track means connected together. Finally, FIGS. 1-9 and 1-10 show octagonal and hexagonal units formed by the track means 1A-1D. The LED-units installed in the track means can have any number of LEDs.

FIGS. 1-11 to 1-18 show different sizes and arrangements for the LED-units or LED-assemblies 2A-2D, which include housing means to seal each of the LED-units or LED-assemblies. FIGS. 1-11 to 1-18 also show LED-elements 3 arranged on each of the LED-units or LED-assemblies. FIG. 1-11 shows a track means 1 with a one-piece housing and also illustrates the manner in which LED-units 2A including at least one LED element 3 and conductive means 4 for electrically connecting with buses or conductors in the track means 1 are removably inserted into the track means 1.

The track means 1 can be arranged to replace an LED bulb, fluorescent tube, light bar, or CFL tube, with the properties of the light being determined by inserting light units having desired LED arrangements into the track means. As shown in FIG. 1-12, the track means 1 are joined together in an octagonal track-means made by extrusion that replaces an light tube, each track means having inserted from the ends a plurality of LED-units 2A and a pair of end LED-units 2D. FIG. 1-13 shows respective light units 2A-2C with one, two, and three LED elements 3 and resilient conductive elements 4 for establishing electrical connections with the track means, while FIGS. 1-14 to 1-16 show arrangements of multiple LED-units forming LED-assemblies of different lengths. FIG. 1-18 shows an end unit that provides an end cover for the track, and may further include built-in circuit means, sensor means, switch means, link means, or other electric parts and accessories from the marketplace. FIG. 1-17 shows, by way of example and not limitation, different ways in which the LED elements 3 can be arranged on the LED-units. The number of LEDs on each unit can be any number from one to N, and the LEDs may be arranged to provide a required brightness, color, viewing angle, light beam direction, color temperature, and area.

FIGS. 1-19 to 1-21 show additional combinations of track means 1 and LED-units 2A and 2D having resilient/elastic conductive means 4 that enable the LED-units (or LED-assemblies) to be assembled and disassembled into one or more of the track means 1 in any desired geometric combination with respect to three-dimensional (x-y-z) axes and provide predetermined light functions, performance, and light shows. The alternative track means arrangements of FIGS. 1-19 to 1-21 include a light bar (FIG. 1-19), an L-shaped arrangement for corner or wall-ceiling lighting (FIGS. 1-20), and an arrangement with a square cross-section suitable for use as a desk or floor lamp (FIG. 1-21). Any of these track means arrangements can have different LED-units, as described above, and the track means or LED-units may further include display housings, shades, covers, lenses, and optics means.

FIG. 3 shows an LED bulb with display-means in the form of a bulb glass cover and having 4 track-means, with each track means having 6 LED-means to provide an LED bulb with 24 LEDs that face outward to cover 360 degrees, plus another LED means arrangement at the top of the LED bulb. The LED bulb can have any shape and base as a conventional incandescent bulb, and uses the miniature size of the track-means and removable LED-units to enable the size of the LED bulb and base to match that of the incandescent bulb so that all types of incandescent bulbs can be replaced by an LED bulb.

Furthermore, the current invention can apply the same techniques to replace a conventional fluorescent tube with an LED fluorescent tube (LED-Flo-Tube) having LED means on removable LED-unit(s) to fit within at least one track-means of the LED-Flo-tube with appropriate ends and circuit means to directly use the existing fluorescent tube electric current to turn on and off the LED as desired Alternatively, the new LED-Flo-Tube can be arranged to bypass the conventional fluorescent tube starter system so as to provide a simpler circuit.

FIG. 4 shows various alternative covers, shades, housings, optics lenses, blocking means, stencils, cutouts, openings, windows, or holes that enable the inner LED track-means, LED-unit(s), and LED means to provide all kinds of wall light, which can be applied to a driveway, theater, home, outdoor wall, or surface for offering attractive floor illumination in dark areas, using any material as discussed above, and in which the cost and characteristics can easily be controlled by providing a desired number of LED-units and LEDs, as explained in the notes included in the original drawings.

FIG. 5 shows another wall light application again, in which as in the embodiments of FIG. 4, the inner track-means, LED-unit(s), and LED-means are viewed through a diffuser lens with cutouts, openings, windows, stenciling, holes, printing, laminations, die cuts, heat-transferred or silkscreened patterns, metallization, or other decorative surface finishing as explained in notes included in the original drawings figures. Again, the inner side has the track-means and LED-units and LED-means of the said Light device with display means.

Figures 1, 2, 3, 4, 5, 6, 7, 8:
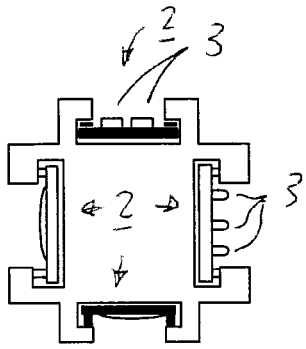
Figures 1, 2:
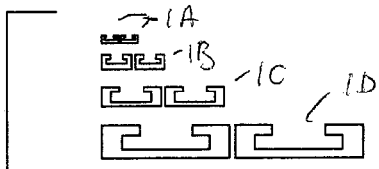
Figures 1, 2, 3, 4, 5, 6:
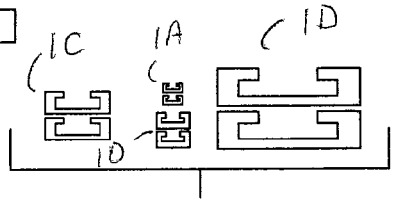
Figures 1, 2, 3:
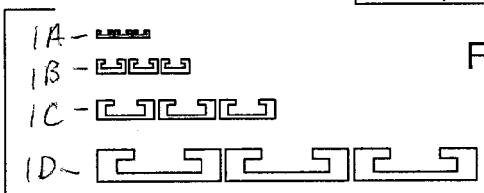

FIG. 6 shows a wall light with reading light applications. The display means can be made of any kind of material including, as explained in the notes included in the original application, textiles, wires, cloth, wood, bamboo, paper, metal, plastic, or other materials. Again, the track-means, LED-units, and LED-means of the light device are on an inner side of the display means and the number of LED-units and LEDs can be selected according to desired costs and illumination area.

FIGS. 7 and 8 show further examples of wall lights with display means selected from an optics means, lens, reflector, diffuser lens, filter, light-transmitting medium, reflective means, any other related optics parts and accessories, a cover, a housing, shade, decorative means, cutouts, stencils, windows, and/or openings, to form a geometric art image shown on a surface(s), wall(s), or floor(s). Again, the track-means, LED-units, and LED-means of the light device are on an inner side of the display means. As explained in the notes included in the original drawings, the patterns may created in the manner disclosed in the inventor's copending U.S. patent appl. Ser. No. 12/622,000, filed Nov. 29, 2009, and the track means, LED-units, circuit means, sensor means, switch means, and IC means may include features disclosed in the inventor's U.S. Pat. Nos. 7,726,869 and 7,772,230.

Figures 1, 2, 3, 4, 5, 6, 7, 8, 9:
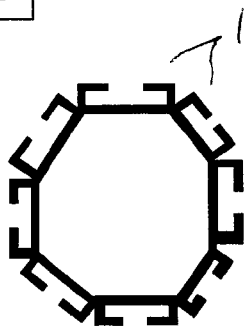
Figures 1, 2, 3, 4:
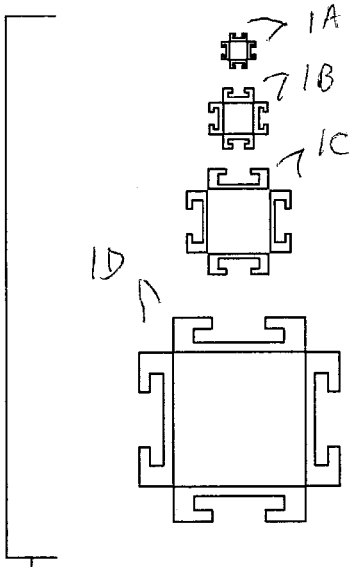
Figures 1, 2, 3, 4, 5, 6, 7:
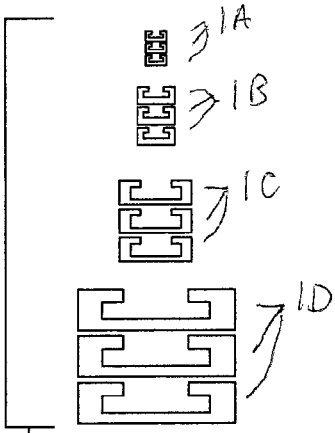

FIG. 9 shows other wall light applications in which light is emitted outward in desired directions from a cover, housing, or shade having cut-outs, openings, windows, stencils, printing, gaps, and/or rings to emit the light from a plurality of areas on the body. Again, the track-means, LED-units, and LED-means of the light device are on an inner side of the display means. Also, as explained in the notes included in the original application, the display means can be made of any kind of material including textiles, wires, cloth, wood, bamboo, paper, metal, plastic, or other materials, and the numbers and arrangements of the track means, LED-units, and LEDs can be selected to only illuminate desired areas, thereby reducing power consumption.

Figures 1, 2, 3, 4, 5, 6, 7, 8, 9, 10:
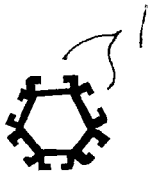
Figures 1, 2, 3, 4, 5, 6, 7, 8, 9, 10, 11, 12, 13, 14, 15, 16, 17, 18:
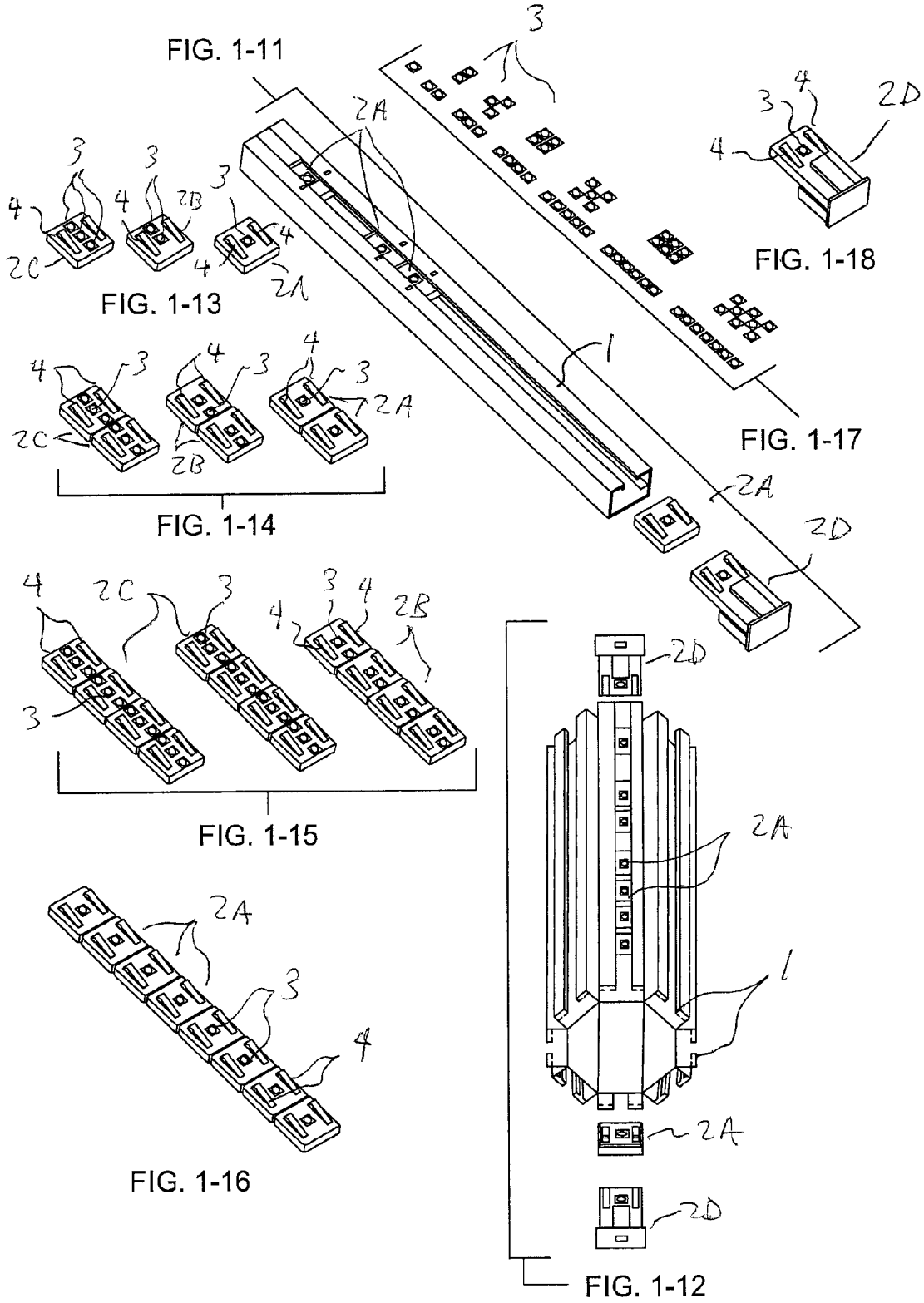
Figures 1, 2, 3, 4, 5, 6, 7, 8, 9, 10, 11, 12, 13, 14, 15, 16, 17, 18, 19:
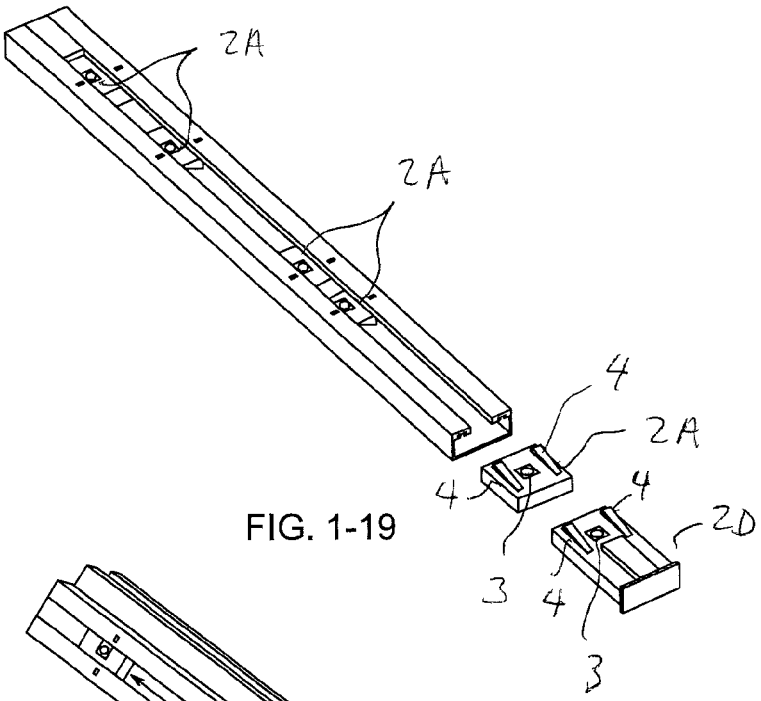
Figures 1, 2, 3, 4, 5, 6, 7, 8, 9, 10, 11, 12, 13, 14, 15, 16, 17, 18, 19, 20:
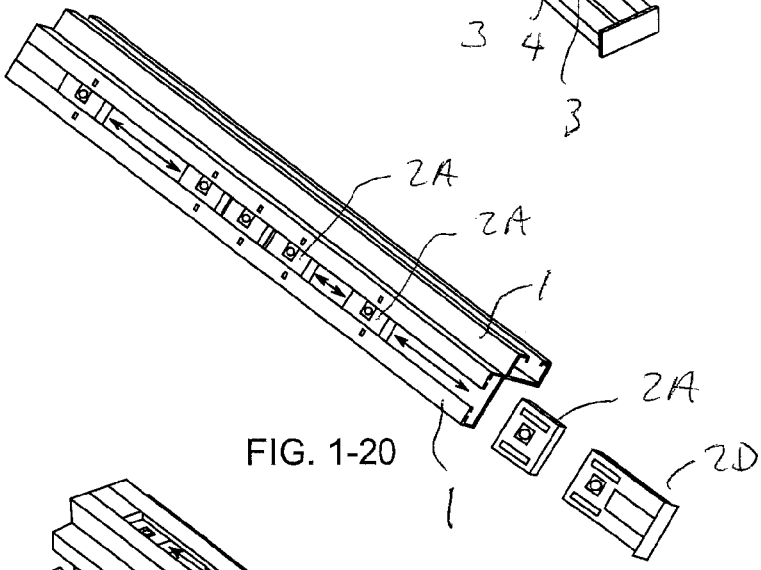
Figures 1, 2, 3, 4, 5, 6, 7, 8, 9, 10, 11, 12, 13, 14, 15, 16, 17, 18, 19, 20, 21:
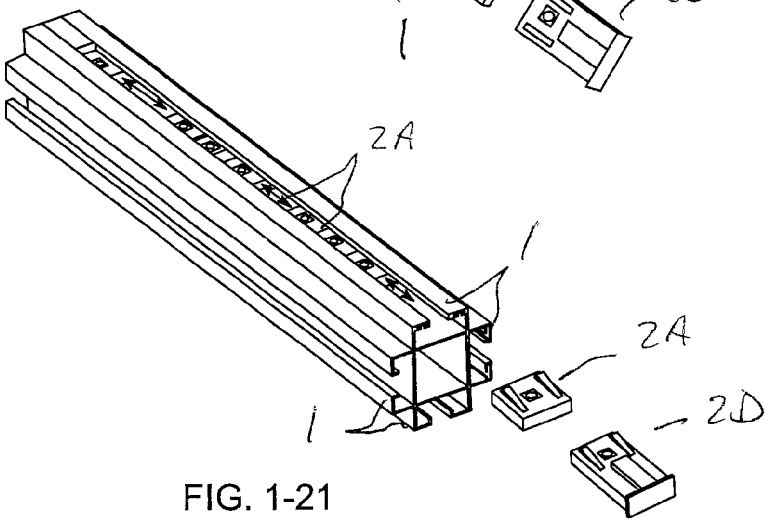
Figure 3:
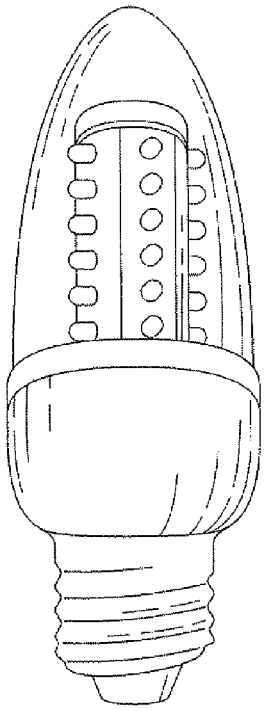
Figure 4:
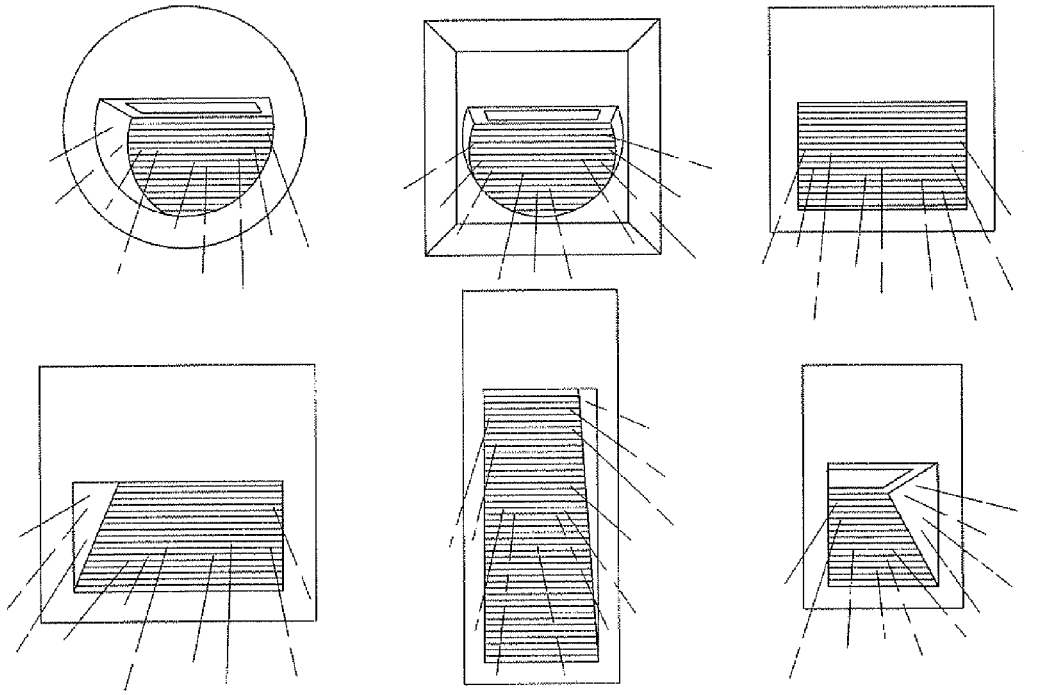
Figure 5:
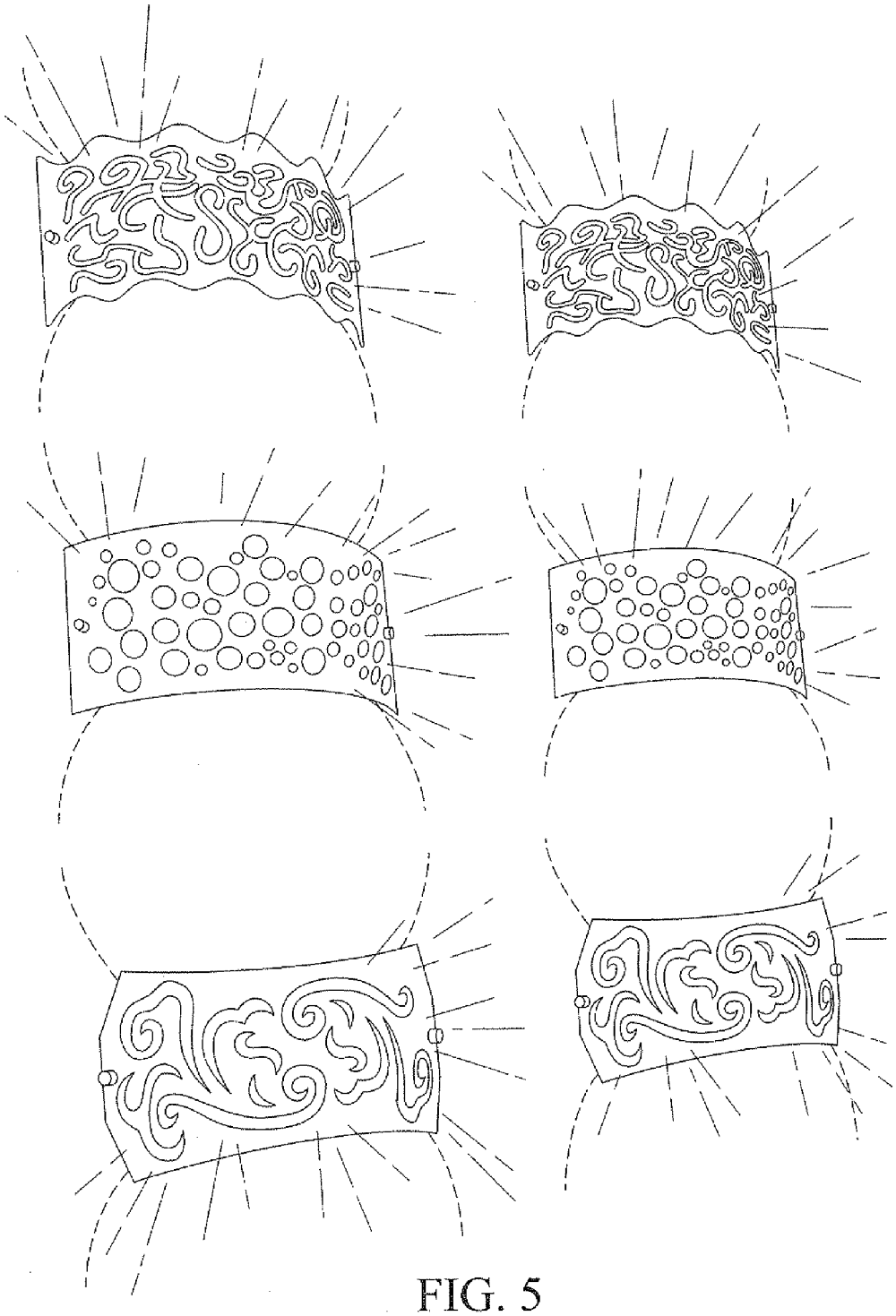
Figure 6:
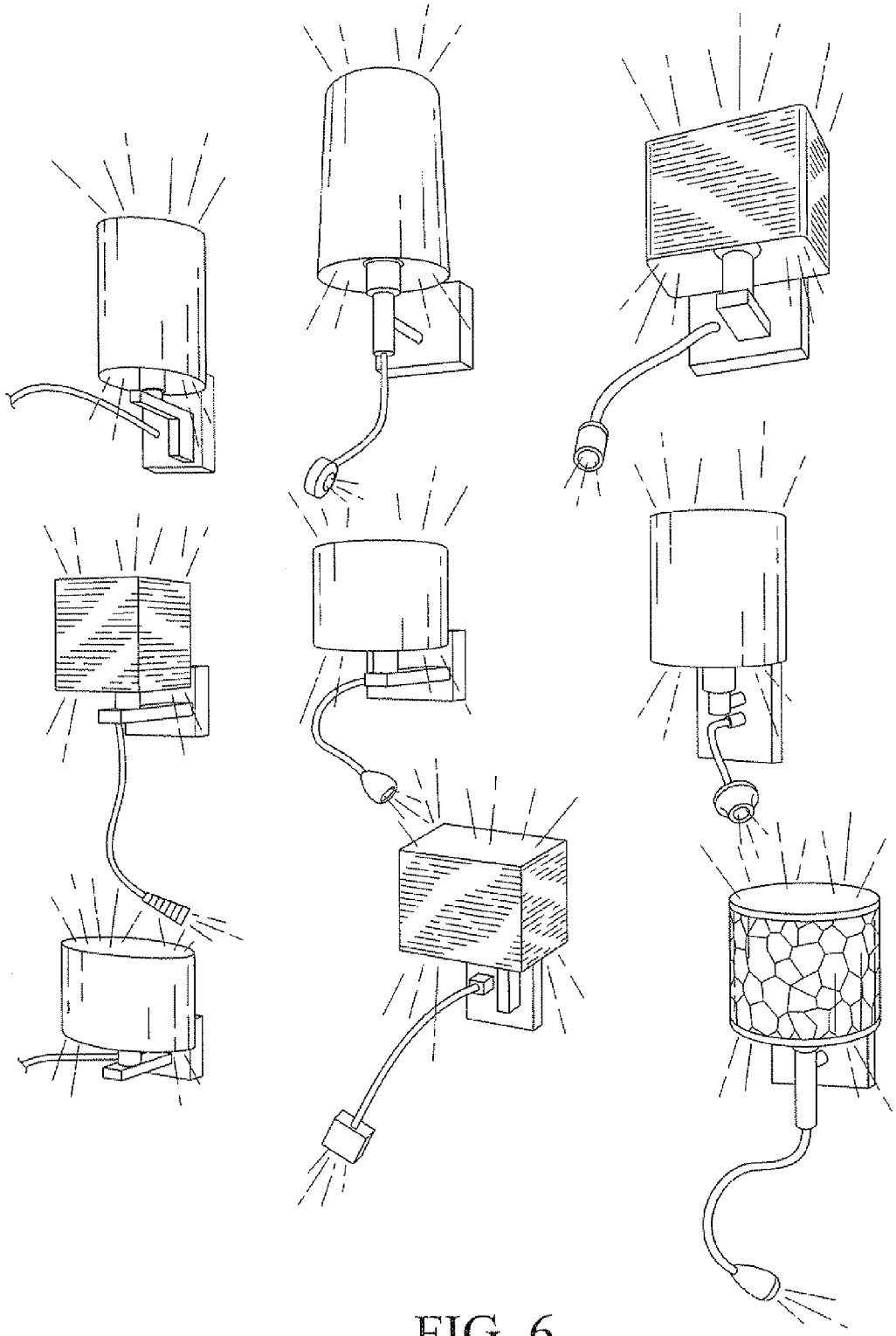
Figure 9:
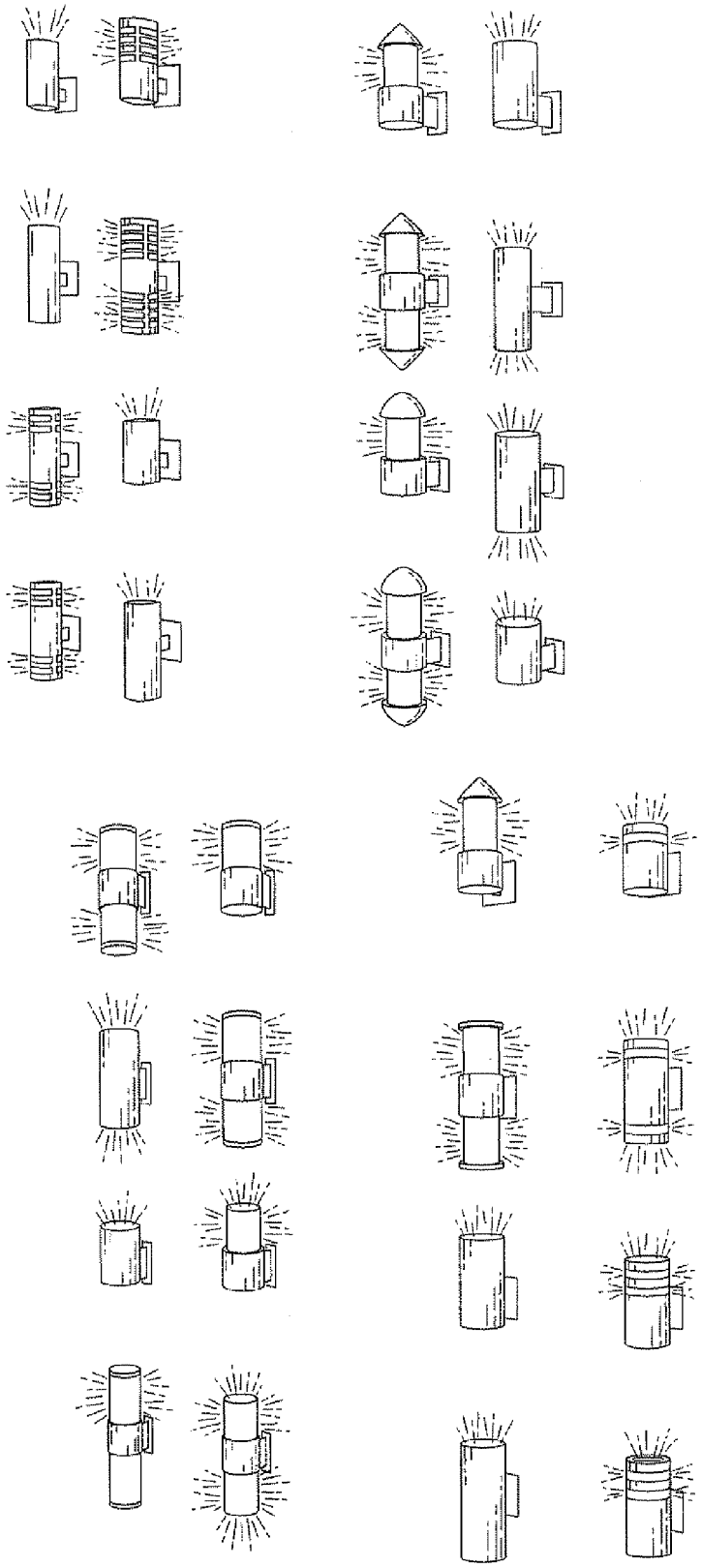
Figure 10:
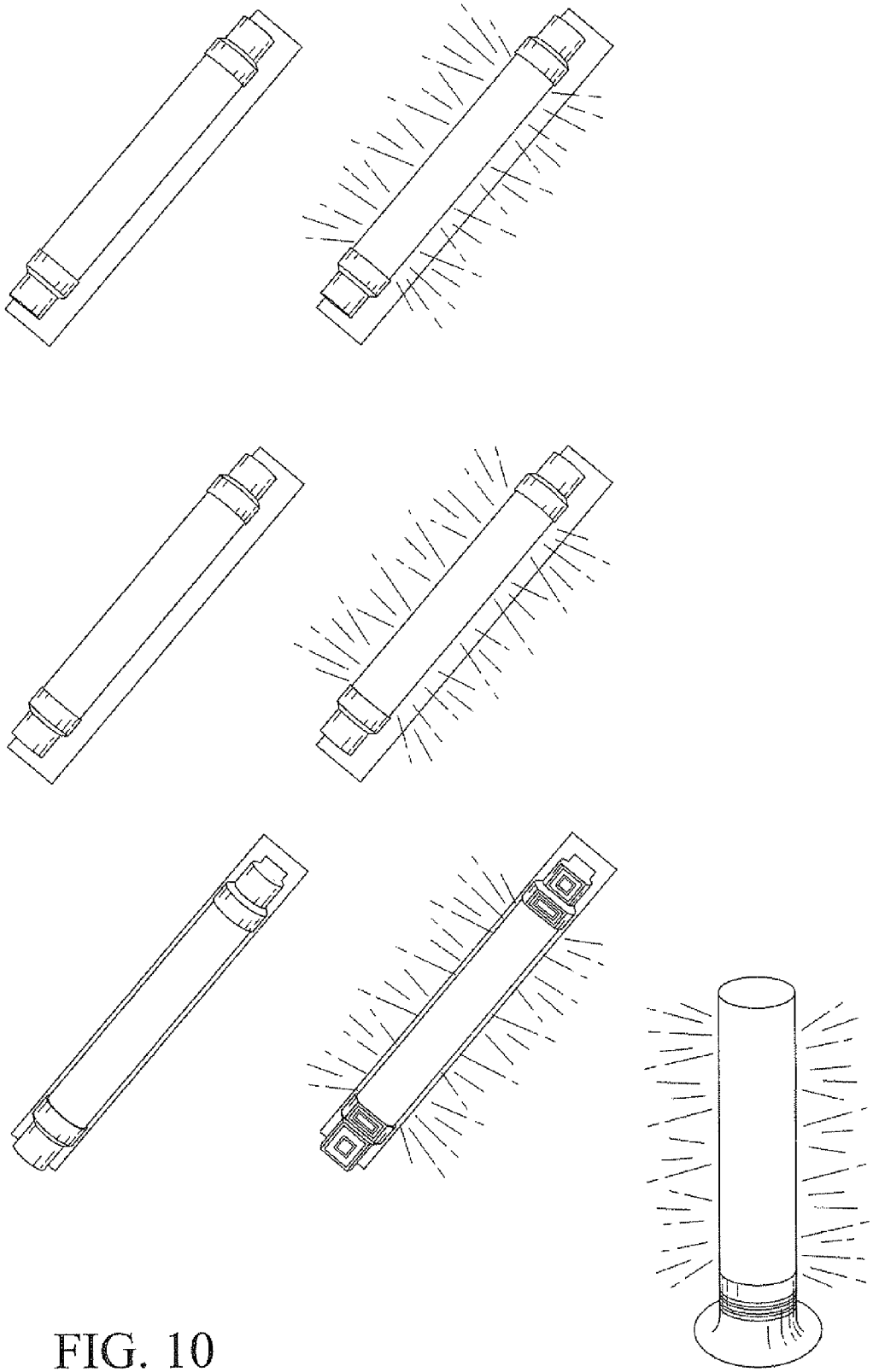
Figure 12:
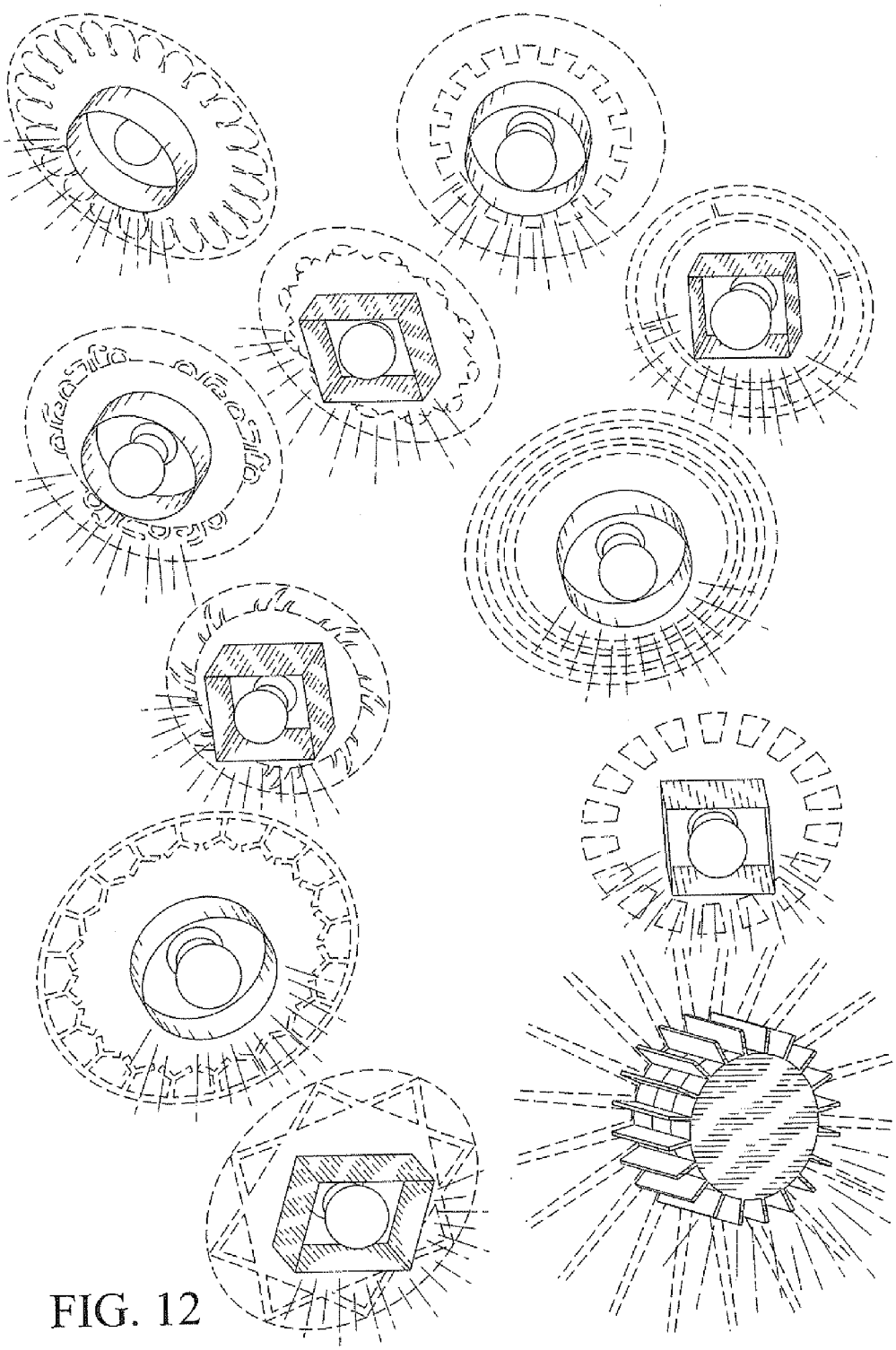

FIG. 10 shows a special-purpose light application incorporating a lens, reflector, optics means, and a liquid medium having air bubbles as decorative means to cover the inner track-means and LED-units. FIG. 11 shows an LED floor light in which the whole length or a partial length has LED-units inside. The inner track-means may have and "L" shape with 2 surfaces for placement in a corner, or more than 3 surface(s), for example a square shape with four surfaces as explained in the notes included in the original drawings, so as to provide 360 degree illumination. The shade, cover, or housing can be made of paper, plastic, bamboo, metal, silicon, chemicals, wood, textiles, cloth, or a foldable material supported by a frame, bar, holder, glue, hook, and so forth to provide a see-though means, opaque means, and/or translucent means with optional patterns formed by stickers, printing, heat transfer, stencils, cutouts, gaps, and windows, to provide desired illumination for indoor or outdoor use.

FIG. 12, like FIGS. 7 and 8, shows a light device that forms geometric art images on surfaces such as a floor or walls. The light device may use high power LED-means at a center location, a light-transmitting medium, and reflective means to allow the light to spread out through an outer stencil, printing, cutouts, openings, windows, silkscreen, or blocking means to form the geometric art on the surfaces, walls, or floor where they can be seen. When formed on the wall, the patterns appear as electronic wallpaper, as explained in the notes included in original FIG. 12. The geometric art concept is disclosed in the inventor's copending U.S. patent application Ser. No. 12/622,000, but the concept is modified to utilize the track means and LED units of the present invention.

The invention thus provides a light device with display means, track-means, and removable LED-units, each removable LED-units having at least one LED-means to provide a desired light beam output to a viewer when the electrodes of the LED-unit(s) are connect to a power source via the track means and any combination of a resilient conductor means, contact means, conductive means, circuit means, buss means, wire means, adaptor means, transformer means, inverter means, IC means, inductor means, electric parts and accessories, and outlet means, the power source including either of an alternating current (AC) or direct current (DC) source, including a wall outlet, generator, batteries, or a source of solar power, wind power, chemical power or any power form available from the conventional marketplace. The LED-units connected to bus means in the track-means by resilient conductive means in the LED-units. The bus-means supplies an electric signal to the electrodes of the LED-unit(s), and thence to the circuit means and related electric parts and accessories to turn on the LED-means on the LED-units to provide a desired light output, color, brightness, functions, features, and performance.

The display means of the light device include display parts and accessories selected from one or more of a cover, lens, optics means, reflective lens, diffuser, filter lens, blocking means, stencil, cutouts, windows, openings, geometric art means, hologram means, lenticular means, 3D film, housing, shade, and decorated parts and accessories made of plastic, wood, bamboo, paper, textiles, garments, cloth, metal, pottery, ceramics, glass, chemical compounds, crystals, minerals, and recycled materials, and may further include attachment means, frame means, holder means, fixing means, glue means, clip means, installation means, extendable means, transformer means, and foldable means to add the display parts and accessories to the track-means to become finish products. The finished product may be any of an (1) LED desk Lamp; (2) LED wall lamp; (3) LED floor lamp (4) LED under-cabinet light; (5) LED brick light; (6) LED step light; (7) LED parking light; (8) LED light fixture; (9) any other conventional LED light(s); (10) LED bulb which has at least one of the track-mean(s) and removable LED-unit(s); (11) LED-fluorescent tube; (12) extendable light bar; and (13) LED light that forms geometric art image on a surface, floor, or wall.

The track-means may have different sizes to fit into a space in the display means ranging from 1 centimeter (0.4 inch) up to multiple meters or tens of feet, and the display means may be at least partially in front of the LED-means or LED-unit(s). The size of the track-means and removable LED-unit(s) may be such that a ratio of the size of the said track-mean(s) to a size of the LED-unit(s) means is a constant, such that a bigger track-means(s) will have bigger LED-unit(s) means, and at least one of LED-unit(s) fits within the length of the track-means. This ratio can be anywhere from 1 to 1,000 to 1 to 0.99 to allow the track-means to have at least one LED-unit up to 1,000 LED-units, while still supplying a proper electric signal to drive the LED-means for pre-determined functions, effects, performance.

The LED-means or LEDs can have any specifications of conventional market available LEDs to enable the LED-unit (s) to provide a desired color assortment, brightness, emitting directions, and optics means to get desired functions or effects. The display means may be arranged to hide the track-means but allow light beams to be seen, and may include a desired combination of one or more of the following: blocking means, printing, stencils, cutouts, openings, light-transmitting media, reflective means, and/or masking to cause the LED light beams passing through to form geometric art images on surfaces such as a floor or walls.

The track-means and LED-unit(s) may be sealed within an extendable means to enable adjustment of the total length of the light device from a desired maximum length to a shortest length in order to fit different spaces, rooms, walls, or distances for illumination.

When applied to an LED bulb, the LED bulb may have a base which has an elastic tip that can allow people to fasten the LED bulb more reliably without over-twisting and damaging the LED bulb.

The invention claimed is:

1. A light device, comprising:

at least one track-means and at least one removable LED-unit arranged to be installed in the track means, each of the at least one removable LED-unit including an arrangement of at least one LED;

display means through which light from the at least one LED passes to an exterior of the light device when electrodes of the at least one LED-units are connected to a power source, wherein the electrodes of the at least one LED-unit are connected to a bus means within and extending along the track means by at least one of a resilient conductive means, contact means, circuit means, bus means, wire means, adaptor means, transformer means, inverter means, IC means, inductor means, electric parts and accessories, and wherein the power source includes at least one of an alternating current (AC) and a direct current (DC) power source and power from the power source is supplied to the electrodes of the at least one LED-unit through the bus means within the track means;

wherein the bus means supplies an electric signal to the at least one LED-unit to turn on the at least one LED and provide desired light output, colors, brightness, functions, features, and performance, wherein the display means comprises display parts and accessories that form a cover, housing, or shade, said display parts and accessories including at least one of a light-transmitting piece, lens, optics means, reflective lens, diffuser, filter lens, light blocking means, stencils, cutouts, windows, openings, masking, geometric art forming means, hologram means, lenticular means, 3D film, and decorated part, said cover, housing, or shade including parts made of one of the following materials: plastic, wood, bamboo, paper, textile, garment, cloth, metal, pottery, ceramic, glass, chemical compounds, crystal, minerals, and recycled material, and said cover, housing, or shade further including at least one of an attachment means, frame means, holder means, fixing means, glue means, clip means, installation means, extendable means, transformer means, and foldable means for installing said display means with respect to said track means in said light device to form a finished product, and wherein said finished product includes one of an: (1) LED desk lamp; (2) LED wall lamp; (3) LED floor lamp; (4) LED under-cabinet light; (5) LED brick light; (6) LED step light; (7) LED parking light; (8) LED light fixture; (9) LED light with a cover, shade, or housing; (10) LED bulb; (11) LED-fluorescent tube; (12) extendable light bar; and (13) LED light arranged to form geometric art images on a surface, floor, or wall.

2. The light device of claim 1, wherein the track-means has a size of between 1 centimeter (0.4 inch) and a plurality of meters.

3. The light device of claim 1, wherein the at least one LED-unit includes a plurality of said LED-units removably installed in said track-means.

4. The light device of claim 1, wherein the display means is positioned at least partially in front of the at least one LED-unit.

5. The light device of claim 1, wherein the display means extends in three dimensions.

6. The light device of claim 1, wherein a size of the track-means relative to a size of the at least one-LED unit is defined by a positive ratio such that a bigger track-means is arranged to receive a bigger LED-unit.

7. The light device of claim 6, wherein at least one said LED-unit is installed within a length of the track-means.

8. The light device of claim 6, wherein a ratio of length of the at least one LED-unit to a length of the track means is between 1:1,000 and 1:0.99 to allow the track-means to receive between one said LED-unit and a thousand said LED-units.

9. The light device of claim 8, wherein each said LED-unit has between one and 1000 of said at least one LED, each supplied with an appropriate electric signal to drive the respective LED according to predetermined functions, effects, and performance.

10. The light device of claim 1, wherein the at least one LED includes multiple LEDs having predetermined specifications.

11. The light device of claim 1, wherein each said LED-unit has an arrangement of LEDs with desired colors, brightnesses, emitting directions, and optics means to provide predetermined functions and effects.

12. The light device of claim 1, wherein the display means hides the track-means but allows light beam from the at least one light-unit installed in the track means to be seen.

13. The light device of claim 1, wherein the display means includes at least one said light block means, stencil, cutout, opening, and masking to cause LED light beams passing through said display means to form a geometric art image on a surface, floor, or wall.

14. The light device of claim 1, wherein the track-means and at least one LED-unit are sealed within the extendable means to enable adjustment of a total length of the light device to fit different spaces.

15. The light device of claim 1, wherein the display means includes at least one said light block means, stencil, cutout, opening, masking, light-transmitting medium, and reflective means to cause LED light beams passing through said display means to form a geometric art image.

16. The light device of claim 1, wherein the light device is said LED bulb and the display means is a bulb lens that is clear or translucent, and wherein the track means includes multiple track means to emit light beams in different directions.

17. The light device of claim 16, wherein the multiple track-means is included in an extruded metal piece having multiple surfaces.

18. The light device of claim 16, wherein a number of the LED-units installed in each of the track means is been 1 and N, where N is any number.

19. The light device of claim 16, wherein the at least one light-unit provide more than one color, brightness, functions, light effect, or light performance.

20. The light device of claim 16, wherein the LED bulb includes a base having a same size and shape as an incandescent bulb's base.

21. The light device of claim 20, wherein the base of the LED bulb has base has an elastic tip to prevent over-twisting and damage to the LED bulb when installed into a socket.

22. The light device of claim 1, wherein the light device is said LED fluorescent tube and the track-means extends over a certain percentage of the length of the fluorescent tube to fit within a fluorescent tube adaptor, base, socket, or connector ends.

23. The light device of claim 22, wherein the LED fluorescent tube the at least one LED-unit and at least one LED are arranged to limit an angle of light beam emission from the LED fluorescent tube to save power.

24. The light device of claim 22, wherein the track-means is an extruded metal piece having a hexagon or octagon shape with multiple surfaces to enable emission of light in multiple directions.

25. The light device of claim 1, wherein display means applied to the track-means and at least one LED-unit to improve a cosmetic appearance of the light device.

26. An LED bulb having a shape, size, length, diameter, and connecting end that are the same as those of an incandescent bulb to enable the LED bulb to be installed in an existing incandescent bulb socket, wherein said LED bulb includes at least one track-means and at least one removable LED-unit having a length that fits into dimensions of the incandescent bulb to provide a desired illumination area, viewing angle, brightness, color, and Kevin temperature, and at least one circuit means and related electric parts and accessories for supplying the at least one LED with a trigger current signal having a predetermined voltage and current from a power source, said circuit means including bus means with and extending along the track means for supplying said trigger current signal from the power source to the at least one removable LED-unit, and wherein a number and position of the at least one track-means, removable LED-unit, and LED is changeable to enable people to customize the LED light device for any desired indoor or outdoor application.

* * * * *